US005790478A

United States Patent [19]

Besson

[11] Patent Number: 5,790,478

[45] Date of Patent: Aug. 4, 1998

[54] TIME-KEEPING INSTRUMENT, IN PARTICULAR AN ANALOG-TYPE ELECTRIC WRIST WATCH

[75] Inventor: Rene Besson, Geneva, Switzerland

[73] Assignee: Montres Rolex S.A., Geneva, Switzerland

[21] Appl. No.: 652,411

[22] Filed: May 23, 1996

[30] Foreign Application Priority Data

May 24, 1995 [CH] Switzerland ..... 01 538/954

[51] Int. Cl.[6] ..... G04B 9/00

[52] U.S. Cl. ..... 368/66

[58] Field of Search ..... 368/66

[56] References Cited

U.S. PATENT DOCUMENTS

| | | | |
|---|---|---|---|
| 4,074,515 | 2/1978 | Asano | 368/66 |
| 4,226,081 | 10/1980 | Ichikawa | 368/66 |
| 4,228,646 | 10/1980 | Kato | 368/66 |
| 4,236,237 | 11/1980 | Ichikawa | 368/66 |
| 5,446,702 | 8/1995 | Mossuz et al. | 368/66 |

FOREIGN PATENT DOCUMENTS

| | | |
|---|---|---|
| 0415734A3 | 8/1990 | European Pat. Off. . |
| 0621519A2 | 4/1994 | European Pat. Off. . |
| 616046 | 3/1980 | Switzerland . |
| 616296 | 3/1980 | Switzerland . |
| 684623G A3 | 11/1994 | Switzerland . |

*Primary Examiner*—Bernard Roskoski
*Attorney, Agent, or Firm*—Larson & Taylor

[57] ABSTRACT

The wrist watch comprises essentially a battery (10), two electric motors (11, 12) which moves the hands (13, 14, 15) on the one hand and a disk of dates (16) on the other hand, an electronic circuit (23) and a watch-type microprocessor (22). When there is a determination by the electronic circuit (23) of the end of the life of the battery, the microprocessor powers the motor (12) in such a manner that the date displayed in the window (17) of the watch is displaced with respect to its normal position.

9 Claims, 4 Drawing Sheets

TIME-KEEPING INSTRUMENT, IN PARTICULAR AN ANALOG-TYPE ELECTRIC WRIST WATCH

Figure 1:
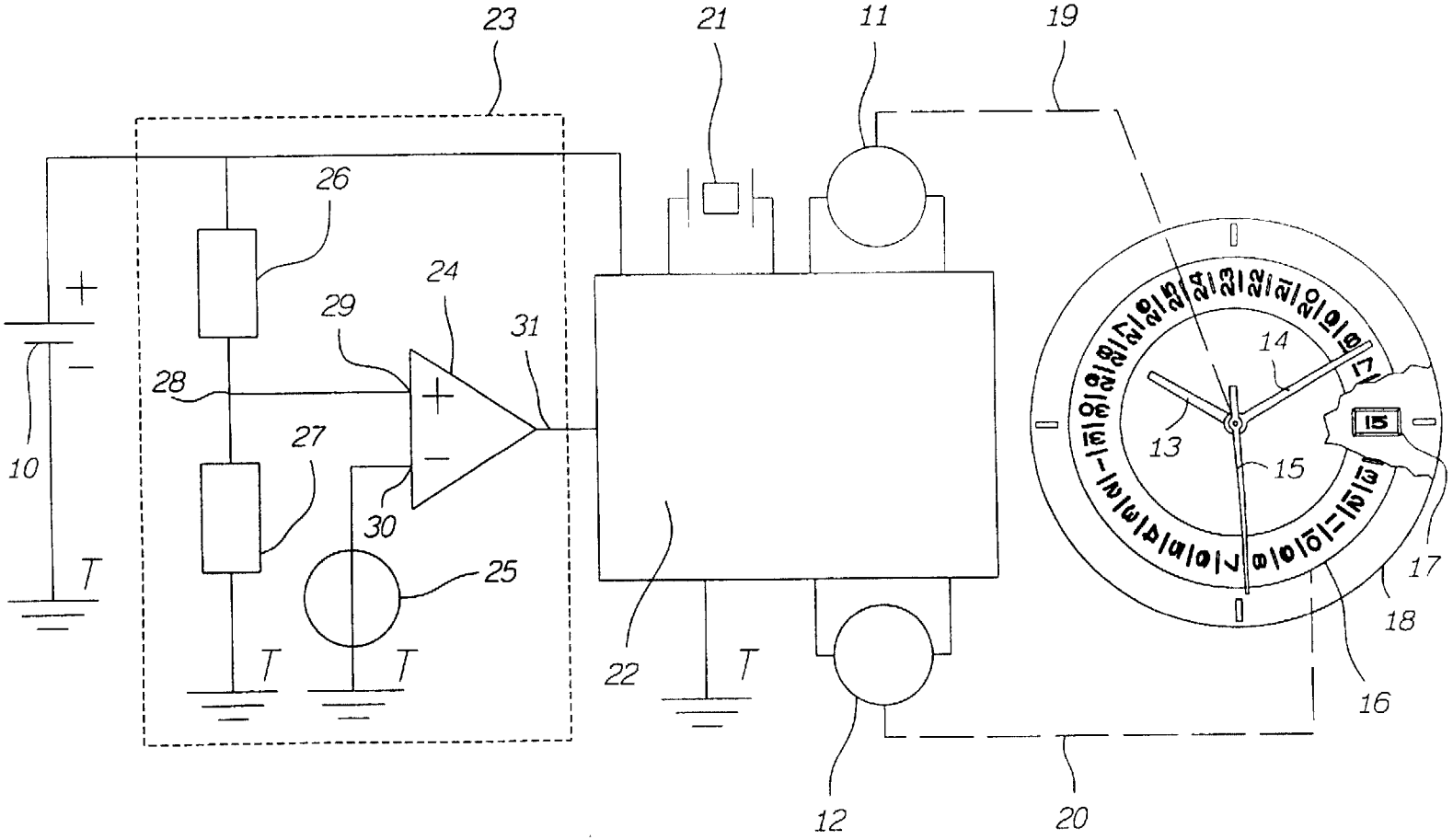

The present invention concerns a time-keeping instrument, in particular an analog-type wrist watch powered by a source of electric energy and comprising at least an indicator of a recurrent cycle driven by a dedicated motor and an electronic circuit adapted so as to control the entirety of the functions of the time-keeping instrument and, in particular, the movement of said indicator of a recursive cycle, this circuit comprising at least a reference of voltage or of internal resistance and a comparator designed so as to detect at least a predetermined level of charge defined by the voltage or the internal resistance of said source of electric energy.

Numerous watches are known with analog displays or numeric displays, principally of the liquid crystal-type, which are provided with means for detecting the end of the life of the battery.

For the watches with numeric displays, the display includes a symbol becoming apparent as soon as the critical level is detected by the measure of the voltage or of the internal resistance of the battery. It is known, in fact, that when the battery approaches the end of its life, its voltage decreases and its internal resistance increases and the detected measurement of the movement of their value on the one side of or beyond pedetermined threshholds permits the detection of the approach of the end of the life of the battery.

For watches with analog displays, there exist other means for alerting their owner to the approach of the end of the life of the battery. One such means is described in Swiss patent no. 616 046 in the name of Citizen Watch Co. Ltd. and comprises an electronic circuit which causes a "wobbling" or irregular oscillation of the second hand which moves four seconds every four seconds. In this same patent is described a complicated electromechanical mechanism comprising a symbol affixed to the end of a hand and which becomes apparent through a window provided in the face called the date window and which is brought above the date disk of the date when the battery approaches the end of its life.

Swiss patent no. 616 046 in the name of Ebauches S.A. proposes to show the end of battery life by a disk placed above a window in the face specially provided for this purpose, this disk being displaced together with the kinematic chain of the analog display, the polarity of the quiescent state of the motor having to be modified during the display of the end of the life of the battery.

Another mode of accomplishing this result is described in the published European patent application no. 0 621 519 of ISA France S.A. The display of a surplus position of an recursive display is generated by an independent motor. In this mode of accomplishing the result, it is necessary to assure that, before the end of the life of the battery, this surplus position is not apparent, which returns to leave out this state, while at the end of the life of the battery, it is necessary to assure the display of the surplus position to the exclusion of normal positions.

Other well-known ways of accomplishing this result are described particularly in Swiss patents Nos. 616 296, 616 046, 684 623. They all present at least one or the other of the defects described as follows.

Some provide a complementary, sometimes complex, mechanism for displaying a signal indication at the end of battery life.

Some impose the creation of an supplemental window in the face which modifies, indeed degrades, the traditional esthetics of the watch.

In some cases, the application is limited because the display is directly tied to the principal kinematic chain of the watch.

In other cases, a supplemental space between the face and the display disk is required which increase the overcrowding and the thickness of the profile.

Certain systems are not reversible. The display of the end of the life of the battery cannot disappear after its appearance, and a battery exposed to the cold can momentarily reach the threshholds of detection, but at an ambient temperature, it recovers its properties of charged battery. It is then necessary to cause the display of the end of battery life, which only appeared momentarily, to disappear.

Certain systems are dependant upon parameters of mechanical construction which are difficult to modify and which do not permit a modification of the length of time of functioning before a change of battery, that is to say that they cannot integrate the technical progress in increasing the average longevity of batteries and in generally reducing the consumption of the movements.

Other systems use an excess position of a moving body to the detriment of the information normally conveyed by the moving body. For example, the display of the date is made to disappear for the benefit of that indicating the end of the life of the battery.

Moreover, certain systems are conceived in such a manner that the display of the approach of the end of the life of the battery necessitates the use of means that consume energy, which has the negative effect of accelerating this approach.

Finally, the systems using the second hand are, of course, only applicable to profiles providing such a hand, which generally is not the case for profiles for ladies watches.

The object of the invention is to remedy the disadvantages of the prior art and to propose a watch comprising means for indicating the impending end of the life of the battery without a supplemental mechanism and that is easy to implement in usual constructions of watchmaking movements.

This object is attained for a time-keeping instrument as defined above and characterized in that said electronic circuit is disposed so as to control a movement of the indicator of the recursive cycle so that the apparent indication furnished by this indicator in its normal mode occupies a first constant position and that the apparent indication furnished by the indicator in case of detection of a level of charge inferior to said predetermined level of charge occupies a second position displaced with respect to said first constant position.

According to a first principal embodiment, the displacement of said second position with respect to said first position remains constant. According to a variant, the apparent indication, when it occupies said second position, can be accompanied by the complementary display of a symbol.

According to a second principal embodiment, the displacement of said second position with respect to said first position is progressive and increases with the diminution of the voltage or the increase of the internal resistance of the source of electric energy.

According to a first particularly advantageous embodiment, the displacement of the second position is effected by stages, each stage corresponding to a predetermined threshhold of voltage or internal resistance of the electrical energy source.

According to a second particularly advantageous embodiment, the displacement of the second position is effected by stages, each stage corresponding to a distinct indication which is displayed automatically within a predetermined time after the detection of said predetermined level of charge.

In these embodiments, each stage of displacement corresponds to the complementary display of a different symbol and said symbol is connected to the indication carried by the indicator of the recursive cycle, provided on this indicator in a displaced manner with respect to the indication, in the direction of the displacement of the indicator.

According to a preferred embodiment, the electronic circuit is disposed so as to control the displacement of the indicator of the recursive cycle in a reversible manner, the display of the indication being displaced in case of the detection of a level of charge less than said predetermined level of charge and becoming normal again in case of detection of a return to a level of charge greater than the predetermined level of charge.

Figure 2:
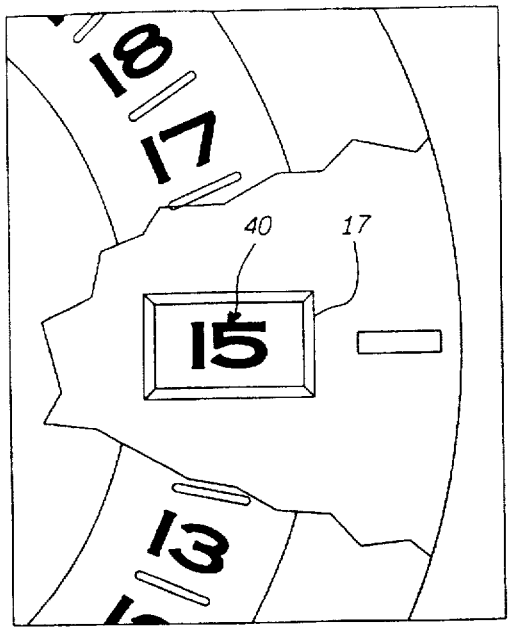
Figure 3:
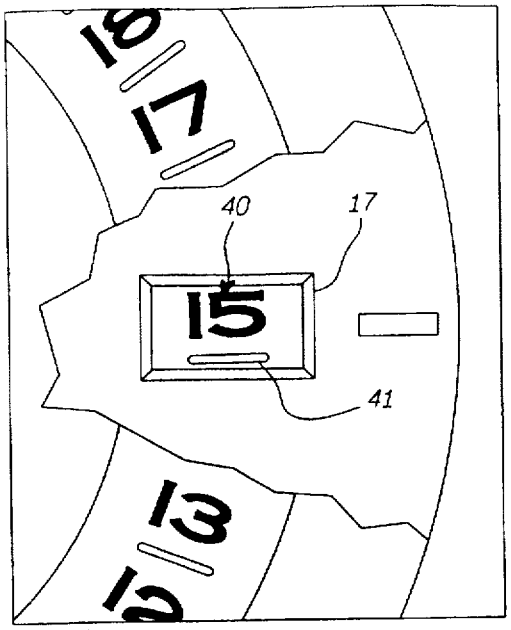
Figure 4:
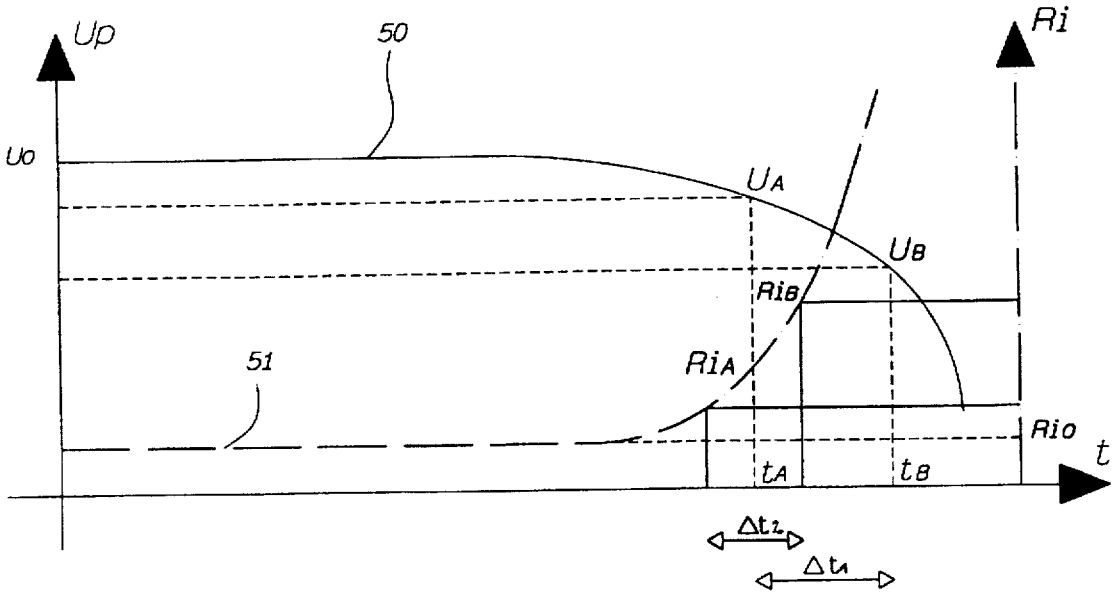
Figure 5:
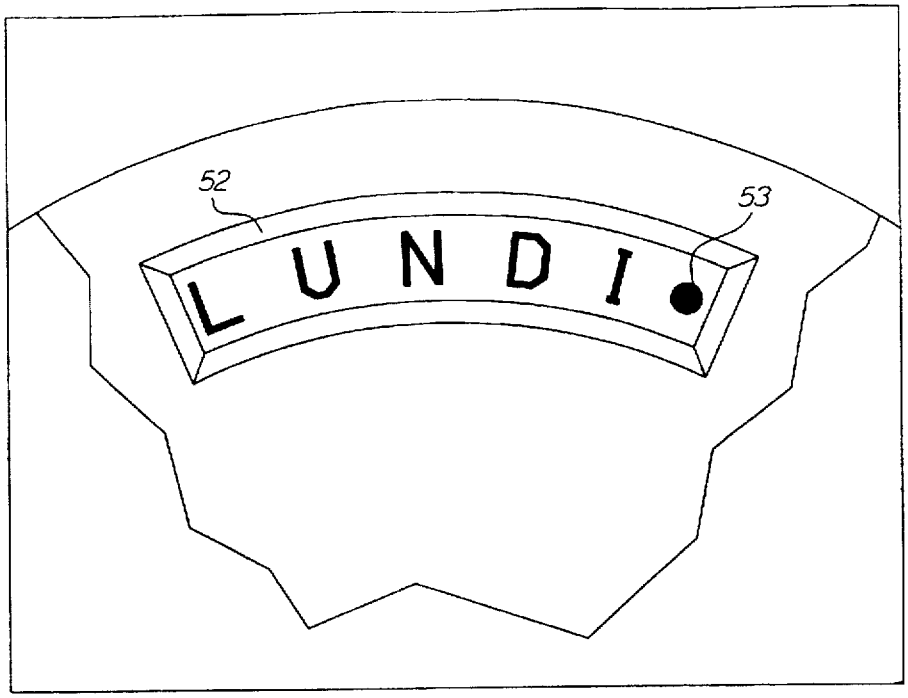
Figure 6:
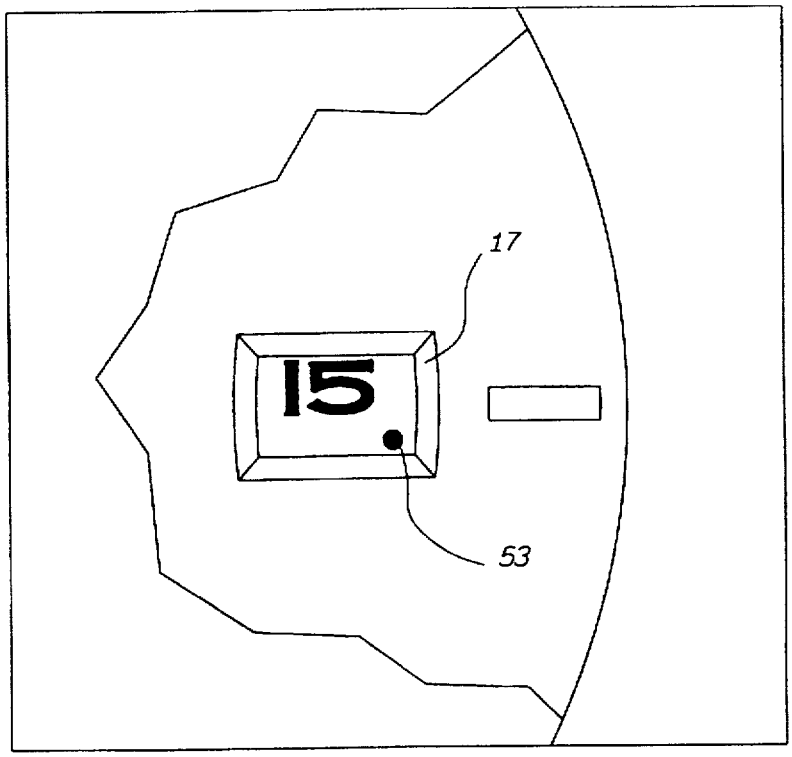

The invention will be better understood with reference to the description of a preferred embodiment given by way of non-limiting example and to the annexed drawings, in which FIG. 1 represents a schematic view illustrating one preferred embodiment of a time-keeping instrument according to the invention, FIG. 2 illustrates the display of the date of the watch of FIG. 1 when it functions in a normal mode, FIG. 3 illustrates the display of the date of the watch when it functions in the mode "end of the life of the battery", FIG. 4 represents a graph which illustrates the evolution of the voltage and of the internal resistance of a battery during the course of its life, FIG. 5 illustrates another embodiment where the display of the day is displaced and accompanied by a symbol in order to signal the approach of the end of the life of the battery, FIG. 6 illustrates an embodiment where the display of the date is accompanied by a symbol in order to signal the approach of the end of the life of the battery, and FIG. 7A, 7B, 7C and 7D illustrate a variant in which different means are used for displaying a progressive approach to the end of the life of the battery.

With reference to FIG. 1, the watch schematically shown comprises a source of electric power 10 constituting a battery which powers an electronic circuit and, via this circuit, two electric motors 11 and 12 which move respectively the hands for the hours 13, for the minutes 14 and for the seconds 15 as regards the motor 11 and a disk of the dates 16 as regards the motor 12. The disk of the dates bears the numbers 1 to 31 arranged, for example, on a circle centered on the axis of the hands, and each number, corresponding to a day of the month, appears successively in a window 17 provided in the face 18 of the watch.

The control connection between the motor 11 and the hands 13, 14 and 15, as well as that between the motor 12 and the disk of the dates 16, are represented respectively by the lines 19 and 20 in dashed/dotted lines.

It can be seen that the date "15", which appears in the window 17, is perfectly centered which signifies, as will be explained below, that the battery is charged and that the watch functions in a normal mode.

The electronic circuit comprises principally a quartz oscillator 21 connected to a watch-type microprocessor 22 which controls directly the two motors 11 and 12, as well as a control circuit 23 for the voltage of the battery. This control circuit comprises essentially a comparator 24, a special circuit 25 known as such, for example from Swiss patent no. 651 999, British patent publication no. 2 111 223 or Swiss patent no. 672 391 adapted to memorize, for example, a reference voltage threshhold or an internal resistance threshhold of two resistances 26 and 27 called respectively resistance divider and resistance bridge. These two resistances 26 and 27 are connected by one of their common terminals 28 to the positive input 29 of the comparator 24. The other terminal of the resistance 26 is connected to the positive terminal of the battery. The negative input 30 of the comparator 24 is connected to the special circuit 25 which is moreover connected to the ground T by its other terminal. The output 31 of the comparator 24 is connected to the microprocessor 22.

In this embodiment, the recursive parameter is the date. It could be replaced by any other recursive parameter such as, for example, the day, the week, the month or the year. The disk which carries the indication of this recursive parameter is driven by an independent motor by a kinematic chain which is its own. The displacement of information to the contiguous information is generated by the mot or which is powered by a number of +N or −N steps. This number is preferably between 10 and 300.

The control circuit 23 is adapted to detect the voltage U of the battery or its internal resistance Ri and to compare it to a predetermined threshhold value. When the effective value of the voltage or the internal resistance reaches these respective threshhold values, the circuit 23 transmits an appropriate information to the microprocessor 22 which controls the motor 12 by a number of impulses +M or −M distinct from the number +N or −N of the normal mode. In practice, if N, for example, is equal to 100 impulses, M will be equal to N−n where n is advantageously equal to 10 impulses. The effect of this is to cause a displacement of the recursive display in such a manner that the information displayed, in this case the date, remains perfectly visible in the window 17 but is displaced with respect to its normal position in order to bring to the wearer of the watch complementary information that he will interpret as the indication of the end of the life of the battery.

The displacement can, if necessary, be accompanied by a particular symbol or sign that serves the function of attracting even more the attention of the wearer to the information already implicitly contained in the displacement of the display.

In permitting the movement of the disk 16 for the dates, day, month or year, constituting said recursive parameter, to be proportional to the number of steps traveled by the motor 12 or the feed impulses furnished by the microprocessor 22, the apparent displayed surface corresponds to the proportion n/N of the total surface of the window. If N=100 and n=10, the apparent surface useful for displaying the end of the life of the battery by means of a symbol completing the displacement is 10% while the surface useful for displaying the recursive parameter remains 90%, which is largely sufficient so that this information remains readable.

FIG. 2 shows in an enlarged fashion the aspect of the display of the date 40, in this case the 15th day, in the window 17 when the watch functions in a normal mode.

FIG. 3 shows this display when the battery arrives at the end of its life. On the one hand, the date 40 is displaced upwardly and on the other hand, under the 15th day of the month appears a dash 41 which is masked in the normal mode. In this case, the movement of the date disk corresponds to N−n steps, the number n of steps lacking being responsible for the observed displacement.

In this embodiment, the visualization or the signaling of the end of the life of the battery is transmitted to the user of the watch by two signs which complement each other: one is the displacement of the date which is considered as the principal sign, and the other is the dash which could besides be replaced by any other sign or ideogram chosen by the manufacturer.

FIG. 4 represents the evolution of the voltage Up of the battery of a watch and of its internal resistance Ri as a function of time t. The curve 50 which corresponds to the voltage varies with time. This voltage is substantially constant and has a value $U_o$ during an interval of time which can be for several years. It decreases more and more rapidly as the battery approaches the end of its life, that is to say when it comes to the end of its charge. On this curve are marked, for example, two thresholds $U_A$ and $U_B$ which are reached respectively at the instant $t_A$ and the instant $t_B$ separated by an interval of time $\Delta t_1$. There exist, in fact, several ways of obtaining the display of the end of battery life. One way can consist of detecting the first threshhold $U_A$ and proceeding to a display such as is described in reference to FIG. 3. Another way consists of detecting the first threshhold $U_A$ and proceeding as described above, then detecting the threshhold $U_B$ in order to reinforce this display, for example by increasing the displacement of the date. A third way can consist of detecting the other threshholds $U_C$, $U_D$, etc. and increasing each time the displacement by the display of a symbol or an ideogram.

Finally, a fourth way can consist of only detecting a single threshhold $U_A$ and displaying a first displacement accompanied or not by a sign at the moment $t_A$ corresponding to this detection, then displaying one or several progressive displacements equally accompanying or not the signs after the intervals of time $\Delta t_1$, $\Delta t'_1$, $\Delta t''_1$ etc., these time intervals being able to be equal or preferably decreasing.

The same observations are applicable to the internal resistance $R_i$ which is substantially constant and equals $R_{i\,o}$ as soon as the battery is charged as is shown by the curve 51 of FIG. 4 and which increases as the battery approaches the end of its life. In order to detect this end of life, one can detect a threshhold $R_{iA}$ of this internal resistance and proceed to display the displaced date. As above, the displacement can be increased when a second threshhold $R_{iB}$ is detected. The detection of these two threshholds is separated by an interval of time $\Delta t_2$ which could equally serve as a base reference for determining at what moment the displacement of the display of the date should be increased. As above, the number of threshholds detected is not limited to two and the displacement, as well as the display of signs, can be progressive.

Diverse embodiments for displaying signs indication the end of battery life are illustrated by the following figures.

FIG. 5 displays the day in the interior of a window 52. One notes that the displayed day, in this case "LUNDI" (Monday), is not laterally centered in the interior of the window and that it is accompanied by a dot 53. One finds again in this embodiment, at the same time, the displacement and the complementary sign.

FIG. 6 represents the displaced display of the day, in this case, the fifteenth day of the month displaced in the window 17. It is accompanied by a dot 53 similar to that of FIG. 5.

One notes in these two examples, besides in that of FIG. 3, that the displacement is always effectuated in the direction of the displacement of the support, that is to say of the disk of the date and of the disk of the days. The complementary sign is associated with the indication but only appears when this indication is displaced. In normal operation, the sign is masked by the face and does not appear in the window.

Figure 7A:
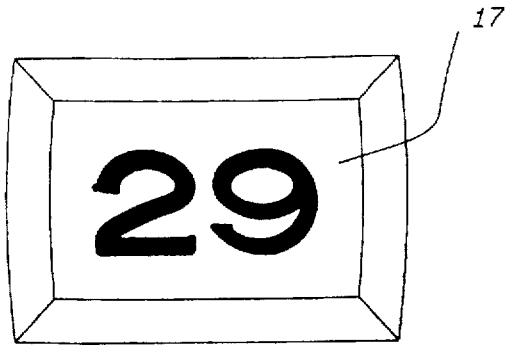
Figure 7B:
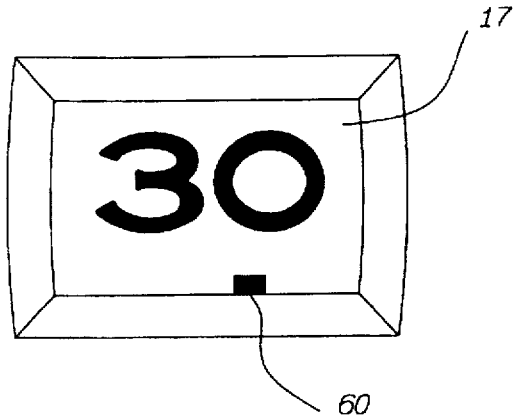

FIGS. 7A, 7B, 7C and 7D illustrate a progressive displacement of the display of the date and a progressive variation of the display of the complementary signs. FIG. 7A represents the window 17 in which appears the date "29", perfectly centered. The battery is charged; the watch functions in its normal mode. FIG. 7B represents the window 17 in which the date "30" appears, displaced and accompanied by a sign 60 having the form of a first rectangle. This displaced display corresponds to the detection of a threshhold $U_A$ or $R_{iA}$ of the voltage or the internal resistance of the battery.

Figure 7C:
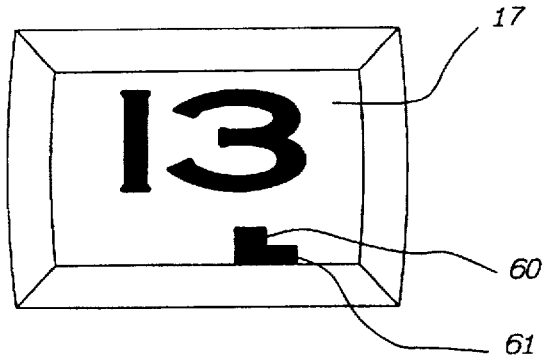

FIG. 7C represents the window 17 in which the date "13" appears displaced, the displacement being amplified with respect to that of the date "30" of FIG. 7B and accompanied by a second rectangle 61 adjacent to the rectangle 60 and greater than the latter. This display can correspond to the detection of a second threshhold of voltage $U_B$ or of a second threshhold of internal resistance $R_{iB}$. However, it can also appear at the end of an interval of time $\Delta t_1$ or $\Delta t_2$ equal, for example, to 14 or 15 days which separate the date "30" from the date "13" of the following month.

Figure 7D:
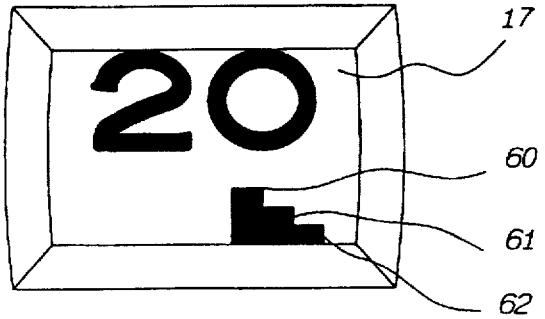

FIG. 7D represents the window 17 in which appears the date "20" again more strongly displaced and accompanied by a third rectangle 62 joined to the precedent ones and bigger than the two rectangles 60 and 61. This display can be the result of the detection of a third threshhold of voltage or of internal resistance or appear automatically after a predetermined time interval following the preceeding displaced display. In the present case, this display appears seven days after the display represented by FIG. 7C.

Diverse variants are possible with regard to this new mode of display as well as of the mode of detection. Each embodiment is a specific combination of these different modes.

One of the advantages of this system with respect to the numerous solutions of the prior art is that it is reversible, in other words, that the "defect of centering" of the indication of the recursive cycle appears as soon as the level of charge becomes insufficient and disappears as soon as it becomes again sufficient. This aspect is especially interesting in the zone of the charge close to the level of predetermined charge on the side of which the displacement occurs. In fact, certain exterior parameters, notably such as the temperature, can have an influence on the state of the charge. A significant temperature decrease provokes generally a fall in the voltage and an increase in the internal resistance of the battery. Hence when the watch is worn in a place where the temperature is low, and when the battery is close to its "critical" level of charge, the threshhold of voltage or of internal resistance is prematurely detected and provokes the displacement of the display.

If the watch is subsequently worn in a place where the temperature is higher, the voltage increases again and the internal resistance decreases and passes anew the threshhold values. The electronic circuit is designed so that the displacement impulses are compensated for. By way of example, if the displacement of the display was generated by a number n of missed impulses, the total number of impulses supplying the motor 11 corresponding to N−n, it would be necessary to supply this motor with N+n impulses so that the following steps are effectuated with the required compensation for the displacement.

I claim:

1. Time-keeping instrument, in particular an analog-type wrist watch, powered by a source of electric energy and comprising at least one indicator of a recursive cycle driven by a dedicated motor and an electronic circuit adapted so as to control all the functions of the time-keeping instrument and in particular the movement of said indicator of recursive cycle, this circuit comprising at least a reference of voltage or of internal resistance and a comparator designed so as to detect at least a predetermined level of charge defined by the voltage or the internal resistance of said source of electric energy characterized in that said electronic circuit is adapted to control a movement of the indicator of recursive cycle such that the apparent indication furnished by this indicator of recursive cycle such that the apparent indication furnished by this indicator in its normal mode occupies a first position and that the apparent indication furnished by this indicator in case of detection of a level of charge less than said predetermined level of charge occupies a second position displaced with respect to said first constant position, and in which the indication of the indicator of a recursive cycle is visible in both first and second position of the indicator.

2. Time-keeping instrument according to claim 1, characterized in that the displacement of said second position with respect to said first position remains constant.

3. Time-keeping instrument according to claim 1, characterized in that the apparent indication, when it occupies said second position, is accompanied by the complementary display of a symbol.

4. Time-keeping instrument according to claim 1, characterized in that the displacement of said second position with respect to said first position is progressive and increases with the decrease of the voltage or the increase of the internal resistance of the source of electrical energy.

5. Time-keeping instrument according to claim 4, characterized in that the displacement of the second position is effectuated by stages, each stage corresponding to a predetermined threshhold of voltage or of internal resistance of the source of electric energy.

6. Time-keeping instrument according to claim 4, characterized in that the displacement of the second position is effectuated by stages, each stage corresponding to a distinct indication which is automatically displayed within a predetermined time limit after the detection of said predetermined level of charge.

7. Time-keeping instrument according to claim 5, characterized in that each stage of displacement corresponds to the complementary display of a different symbol.

8. Time-keeping instrument according to claim 7, characterized in that said symbol is associated with the indication carried by the indicator of the recursive cycle, provided on this indicator in a displaced manner with respect to the indication in the direction of the movement of the indicator.

9. Time-keeping instrument according to claim 1, characterized in that the electronic circuit is adapted to control the movement of the indicator of the recursive cycle in a reversible manner, the display of the indication being displaced in case of detection of a level of charge less than said predetermined level of charge and becoming normal again in case of detection of a return to a level of charge greater than this predetermined level of charge.

* * * * *